US007547074B2

(12) United States Patent
Beach et al.

(10) Patent No.: US 7,547,074 B2
(45) Date of Patent: Jun. 16, 2009

(54) OVERLAPPING PEDESTALS FOR SUPPORTING A BLOCK SECURED TO A ROTATING DRUM

(75) Inventors: Wayne H. Beach, Roaring Spring, PA (US); Stephen P. Stiffler, New Enterprise, PA (US); Eric Paul Helsel, New Enterprise, PA (US)

(73) Assignee: Kennametal Inc., Latrobe, PA (US)

( * ) Notice: Subject to any disclaimer, the term of this patent is extended or adjusted under 35 U.S.C. 154(b) by 241 days.

(21) Appl. No.: 11/612,712

(22) Filed: Dec. 19, 2006

(65) Prior Publication Data

US 2008/0164749 A1 Jul. 10, 2008

(51) Int. Cl.
*E21C 23/88* (2006.01)

(52) U.S. Cl. ..... 299/79.1; 299/102; 299/87.1

(58) Field of Classification Search ..... 299/79.1, 299/87.1, 102

See application file for complete search history.

(56) References Cited

U.S. PATENT DOCUMENTS 4,219,239 A 8/1980 Weikert et al.
5,722,789 A 3/1998 Murray et al.
5,775,781 A 7/1998 Sawtelle et al.
5,791,737 A 8/1998 Cochran
5,842,747 A 12/1998 Winchester
5,904,408 A * 5/1999 Olson et al. ..... 299/87.1
6,149,342 A 11/2000 Phillips
6,213,560 B1 4/2001 Lindblom
6,547,484 B2 4/2003 Murphy
6,779,850 B1 8/2004 Schibeci et al.
6,786,557 B2 9/2004 Montgomery, Jr.
6,832,818 B2 12/2004 Luciano

FOREIGN PATENT DOCUMENTS

JP 07-189212 A 7/1995

* cited by examiner

*Primary Examiner*—John Kreck
(74) *Attorney, Agent, or Firm*—Matthew W. Smith

(57) ABSTRACT

A pedestal assembly for an asphalt cutter and/or a longwall shearer includes a cutting bit detachably secured in a tool body mounted within a block with the block fixedly secured to a pedestal. The first end of the pedestal has a recess to overlap the second end of an adjacent pedestal when the pedestals are mounted on the outer surface of a drum of the cutter. The first end of the pedestal further includes a lateral flat surface portion for deflecting material made loose by the cutting bit.

21 Claims, 5 Drawing Sheets

OVERLAPPING PEDESTALS FOR SUPPORTING A BLOCK SECURED TO A ROTATING DRUM

BACKGROUND OF THE INVENTION

1. Field of the Invention

This invention relates to an overlapping pedestal secured to a rotating drum, such as a rotating drum of an asphalt cutter and/or a longwall shearer, having a plurality of the overlapping pedestals mounted on the outer drum surface and, more particularly, to pedestals having a first end to overlap with a second end of an adjacent pedestal.

2. Discussion of the Technical Problem

Mining and construction machines having rotating drums are used in underground mining, such as for coal mining, to remove the coal from the mine wall or to remove asphalt from road surfaces. In general, the drum has a cylindrical tubular body having pedestals mounted on the outer surface of the drum to remove the coal or asphalt. In a typical arrangement, a pedestal is welded onto the outer surface of the drum, a block is welded to the pedestal and a tool body with a cutting bit secured therein is secured to the block. The pedestals are oriented relative to one another and to the rotating axis of the drum to have a selected configuration to optimize the removal of the coal from the surface of the mine or the asphalt from the road surface. The orientation of the cutting bits to optimize cutting is well known in the art and no further discussion is deemed necessary.

As is appreciated by those skilled in the art, a machine is taken out of service when its efficiency goes below a predetermined value. The efficiency can decrease for several reasons, one of which is damage to the pedestal, including separation of the pedestal from the drum surfaces. In general, pedestals are secured to the cylindrical drums by welds connecting the base of each pedestal with the outer surface of the cylindrical drum. The pedestals, even though they may be generally adjacent to one another, are not connected to one another. The separation of a pedestal from the drum surface is usually the result of the failure of the weld securing the pedestal to the drum surface. This failure is usually the result of drum vibration and/or shear force acting on the pedestals during operation. Replacing pedestals on the drum surface is a time and labor intensive job. In some instances, the entire drum must be removed from the machine, and the detached pedestals welded onto the drum surface at an off-site location.

As can be appreciated, it would be advantageous to provide a pedestal design that provides improved retention of the pedestals to the drum surface resulting in an improved rotating drum, thereby reducing the down time to replace detached pedestals.

DESCRIPTION OF THE PREFERRED EMBODIMENT(S)

This invention relates to a pedestal assembly including, among other things, a pedestal having a bottom surface, an opposite top surface, a first side and an opposite second side, a first end having a recess with a downwardly facing surface, a second end having an upwardly facing surface, wherein the downwardly facing surface and the upwardly facing surface are substantially the same distance from the bottom surface. When mounted upon a rotary drum, the downwardly facing surface of the recess of the first end of the pedestal overlaps and rests upon the upwardly facing surface of the second end of an adjacent identical pedestal.

Non-limiting embodiments of the invention include, but are not limited to, the upwardly facing surface having one of a projection or cavity which is mateable with the other of the projection or cavity in the downwardly facing surface. Furthermore, the pedestal may include an upright member extending above the upper surface of the pedestal with the cutting surface of the cutting bit extending above the upright member. Furthermore, the surface of the upright member facing away from the block may have a reference position. Additionally, the upper surface of the pedestal may include a step.

The invention further relates to a drum assembly for a rotary cutter having an elongated body with a first end, an opposite second end and an outer surface. The body is rotatable about an axis extending from the first end to the second end. A plurality of pedestals on the drum are each adapted to receive a block. Each pedestal has a bottom surface securely mounted on the outer surface of the elongated body and an opposite top surface. For at least one pair of adjacent pedestals, one of the pedestals has a first end with a downwardly facing surface and the adjacent pedestal has a recess with an upwardly facing surface, wherein the downwardly facing surface overlaps with and contacts the upwardly facing surface so that the adjacent pedestals overlap.

Still further, the invention relates to individual pedestals, wherein each pedestal is adapted to be secured to a rotary drum used on a mining or construction machine. Each pedestal is adapted to support a block with a cutting bit therein. Each pedestal is comprised of a body having a bottom surface and an opposite top surface, a first side and an opposite second side, a first end having a recess with a downwardly facing surface and a second end having an upwardly facing surface. The downwardly facing surface and the upwardly facing surface are substantially the same distance from the bottom surface, such that when mounted upon a rotary drum, the downwardly facing surface of the first end of the pedestal overlaps and rests upon the upwardly facing surface of the second end of an adjacent identical pedestal.

BRIEF DESCRIPTION OF THE DRAWINGS

FIG. 2 includes FIGS. 2A-2D.

DETAILED DESCRIPTION OF THE INVENTION

Figure 1:
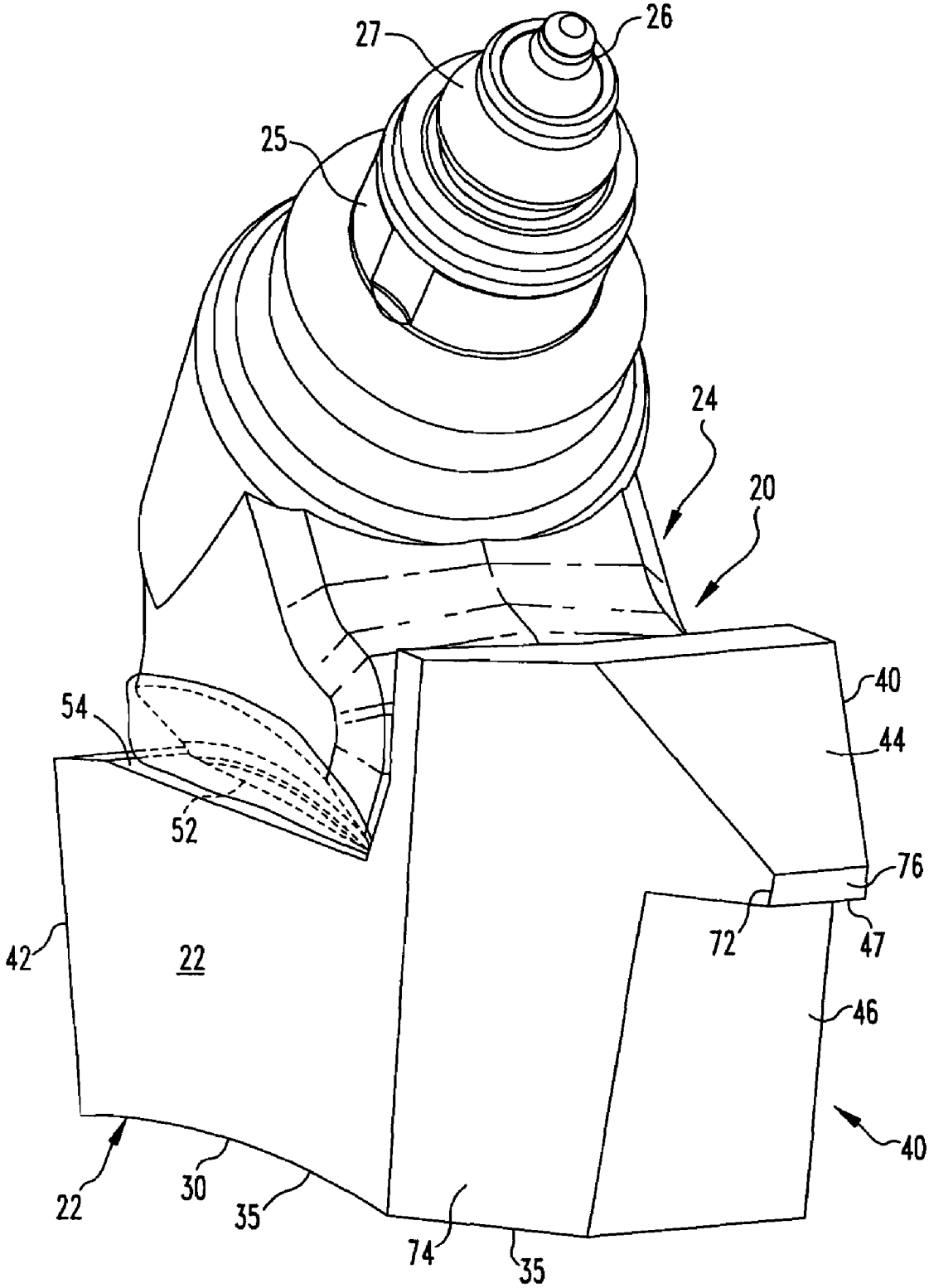
FIG. 1 is an isometric elevated front view of a pedestal assembly incorporating features of the invention.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting.

Before discussing several non-limiting embodiments of the pedestal, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, in the following discussion, unless indicated to the contrary, like numbers refer to similar elements.

The embodiments of the pedestals of the invention are discussed for use on the outer surface of rotating drums of cutting machines. However, the invention is not limited to any particular type of mining or construction machine.

FIGS. 1 and 2 illustrate a pedestal assembly 20 having a pedestal 22, a block 24 fixedly mounted on the pedestal 22 (see FIGS. 2A-2C), a sleeve 25 (see FIGS. 2A and 2B), a tool body 27 within the sleeve 25 (see FIG. 2A and FIG. 2B), and a cutting bit 26 detachably secured to the block 24 (see FIG. 2A) through the sleeve 25 and tool body 27.

The invention is not limited to the material used to make the pedestal 22, the block 24, the sleeve 25, the tool body 27 and the cutting bit 26, and the selection of materials for making such components are well known in the art. For example, the pedestal 22, the block 24, the sleeve 25 and the tool body 27 can be made of metal, e.g. steel, and the cutting bit 26 made of a material harder than the material to be removed, such as cemented carbide.

In one embodiment of the invention, the pedestal 22 has a bottom surface 30 (see FIG. 1) that is contoured to the shape of the outer surface 32 of the drum 34 (see FIGS. 3 and 4) for full surface contact between the bottom surface 30 of the pedestal 22 and the outer surface 32 of the drum 34. It is not necessary for the bottom surface 30 of the pedestal 22 to be in full surface contact with the outer surface 32 of the drum 34. However, the contact should be close enough to weld peripheral edges 35 of the bottom surface 30 of the pedestal 22 (see FIG. 4) to the outer surface 32 of the drum 34 to fixedly secure the pedestal 22 to the outer drum surface 32. While welding is preferred, the pedestal 22 of the cutting tool 20 can be mounted to the outer drum surface 32 in any convenient manner other than welding.

The pedestal 22 may have registration holes 36 (FIG. 2D) to receive registration tabs 37 (FIG. 4) of the block 24. In this manner, the center line 38 (see FIG. 2C) of the tool body 27 can be set at an angle A to the center line 39 of the pedestal 22 to provide a desired cutting angle of the cutting bit 26. However, the angle A can be any angle, for example, an angle between 0 and 180 degrees.

Figure 3:
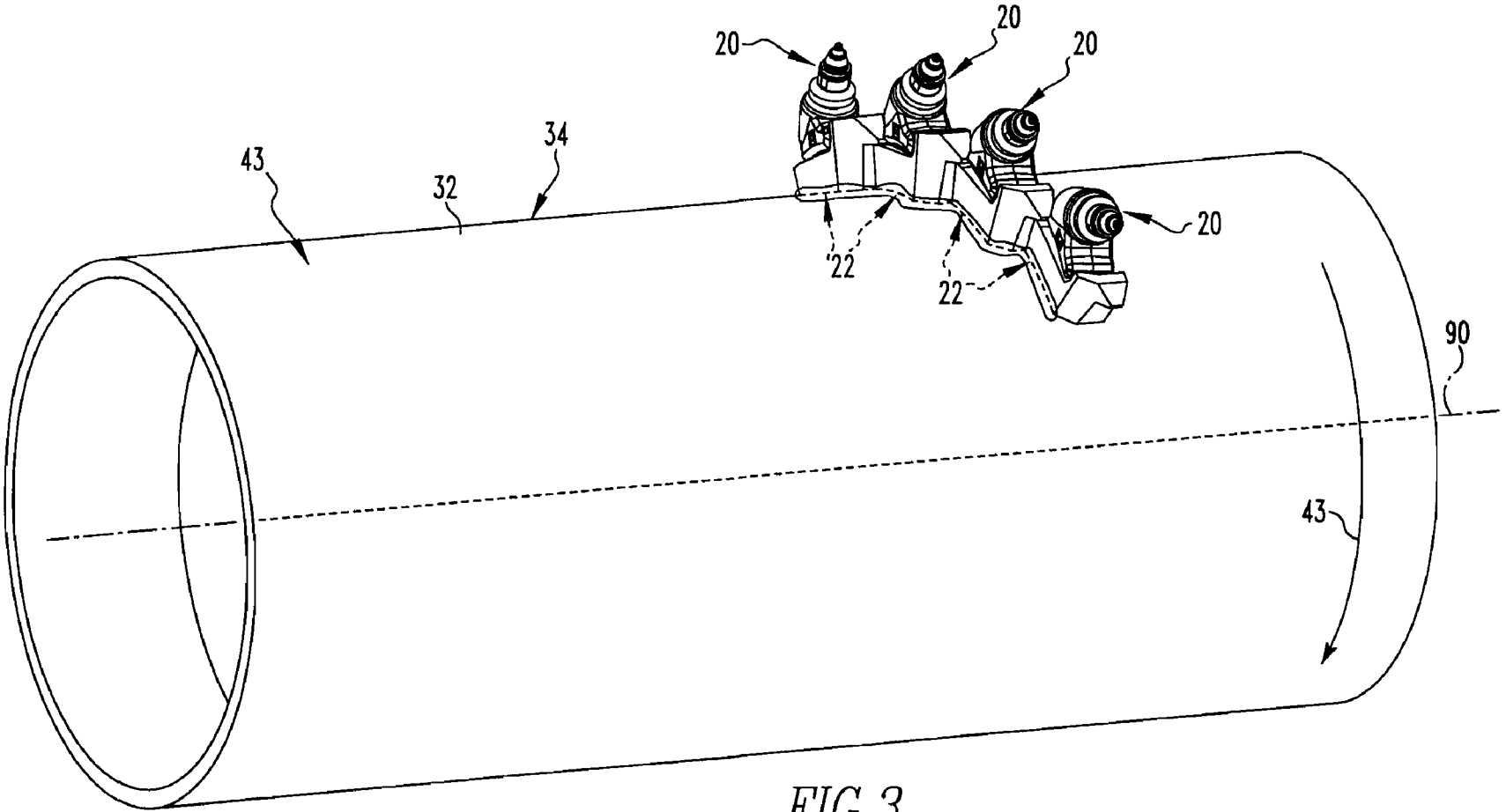
FIG. 3 is an isometric view of a drum having pedestals mounted to the outer surface of the drum.
Figure 4:
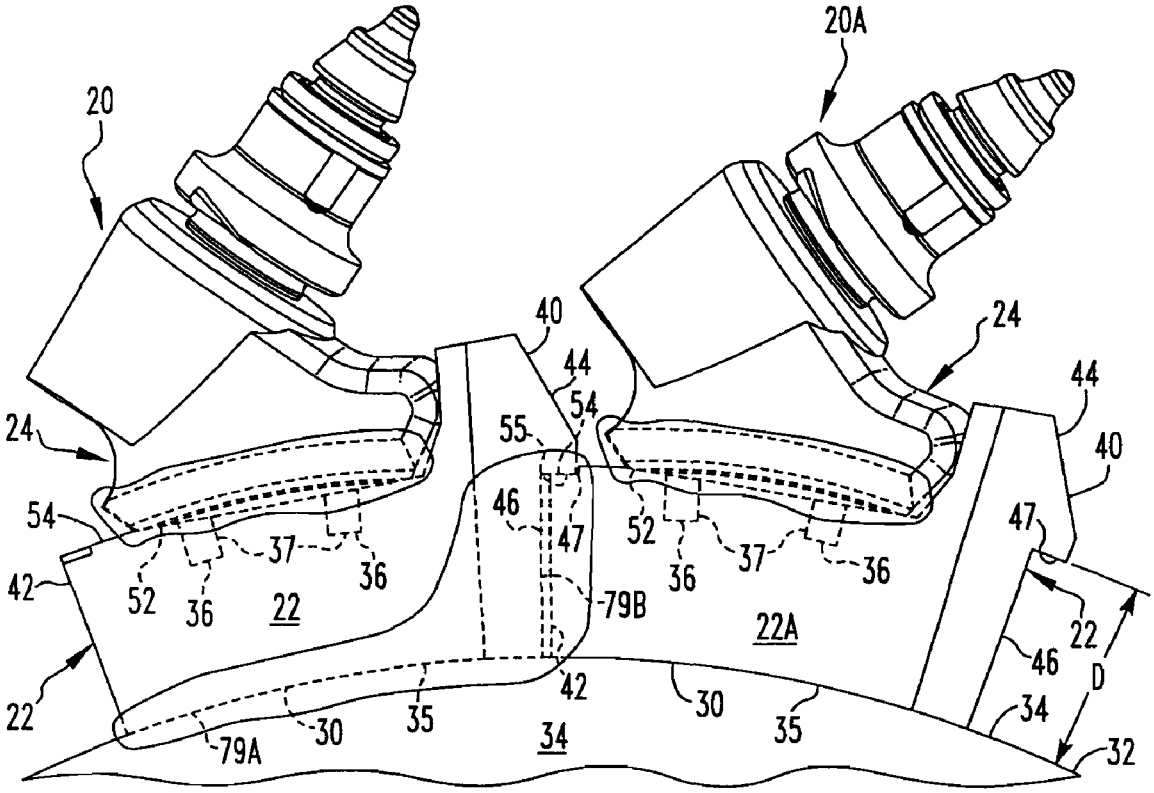
FIG. 4 is an elevated side view of pedestals mounted on the outer surface of the drum.
Figure 5:
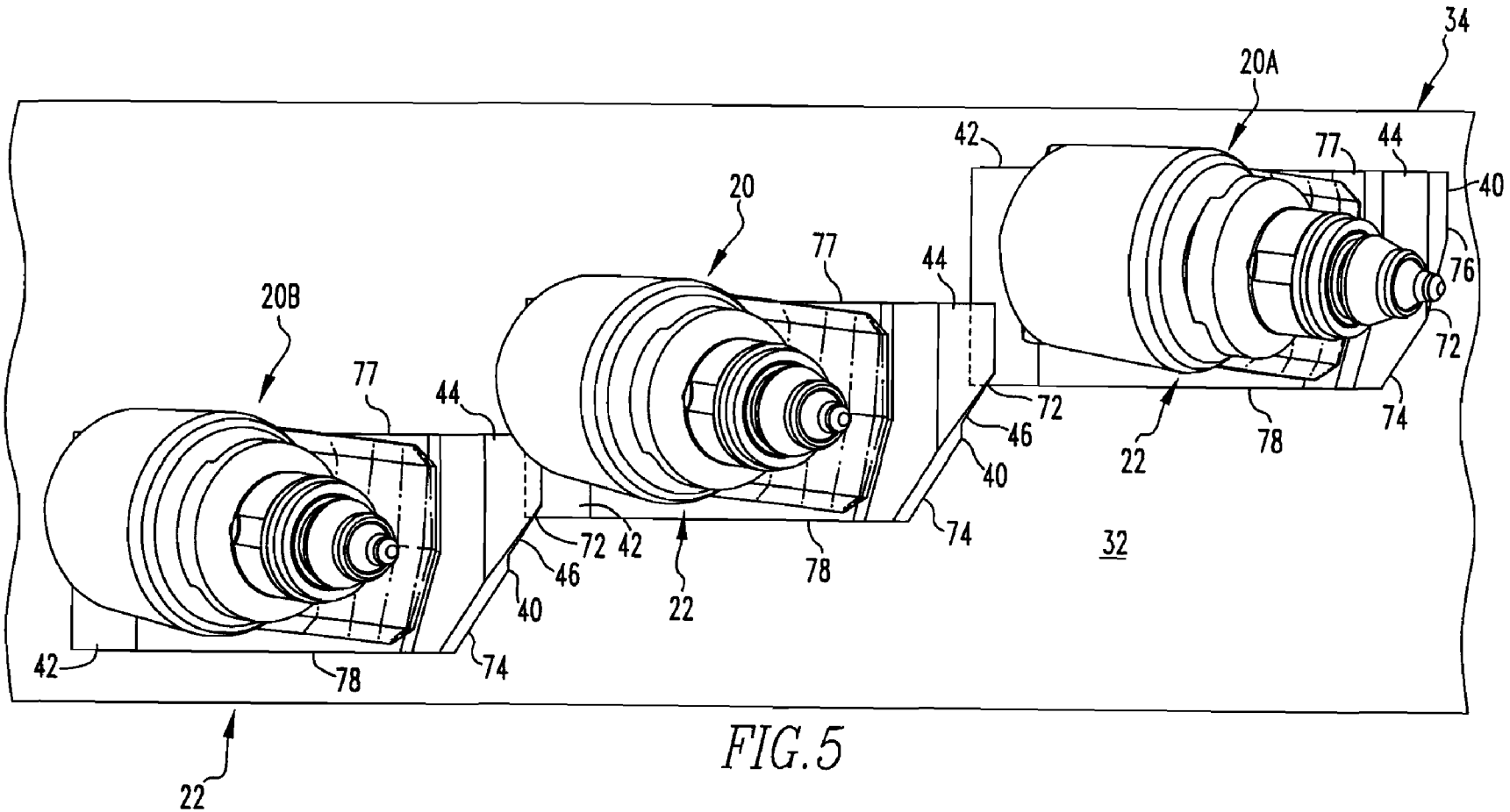
FIG. 5 is a plan view of a plurality of pedestals mounted on the outer surface of the drum.

With reference to FIGS. 4 and 5, the pedestal 22 of the pedestal assembly 20 has a first end 40 to receive a second end 42 of an adjacent pedestal assembly 20A, and the pedestal assembly 20 has a second end 42 insertable in the first end 40 of the adjacent pedestal assembly 20B (FIG. 5). The first end 40 is the leading end, and the second end 42 is the trailing end of the pedestal assembly 20 as the drum 34 is rotated in the direction of the arrow 43 (FIG. 3). The first end 40 has an over-hang member 44 to provide a recess 46 (clearly shown in FIGS. 1 and 4) to receive the second end 42, which is the trailing end, of the adjacent pedestal 22. The recess 46 of the first end 40 has a downwardly facing surface 47. The second end 42 has an upwardly facing surface 54 which is substantially the same distance D (FIG. 4) from the bottom surface 30, such that when mounted upon a rotary drum 32, the downwardly facing surface 47 of the first end 40 of the pedestal 22 overlaps and rests upon the upwardly facing surface 54 of the second end 42 of an adjacent identical pedestal 22A.

Figure 4A:
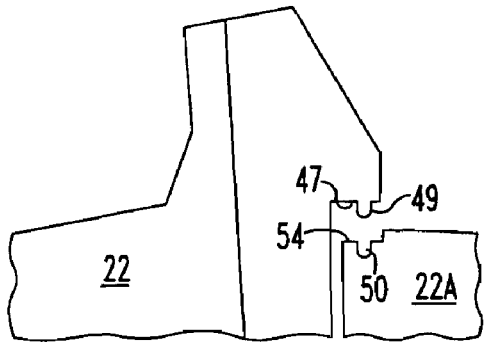
FIG. 4A is a portion of the first end of one pedestal and the second end of an adjacent pedestal with an associated mating projection and cavity.

Additionally, as illustrated in FIG. 4A, the downwardly facing surface 47 may include one of a projection 49 or cavity 50. The projection 49 and the cavity 50 are mateable with one another such that when the two adjacent pedestals 22, 22A are overlapping, the projection 49 and the cavity 50 mate to provide lateral support to the pedestals 22, 22A. With this arrangement, in addition to the pedestal 22 being welded to the drum 34, the first end 40 of the pedestal 22 can be welded to the second end 42 of the adjacent pedestal 22A to provide additional structural stability to secure the pedestals together and to the surface 32 of the drum 34. The bottom surface 30 of the pedestal 22 may be welded to the outer surface 32 of the drum 34 and, additionally, the sides 77, 78 (FIG. 5) of each adjacent pedestal may be welded together. For illustration, FIG. 4 illustrates in phantom, weld 79A between the pedestal 22 and the drum 34 and weld 79B between the first end 40 of pedestal 22 and the second end 42 of pedestal 22A. FIG. 3 also shows the weld 79B between the adjacent pedestals and drum 34.

With reference to FIGS. 1 and 2, the base 52 of the block 24 is fixedly secured to the upwardly facing surface 54 of the pedestal 22 in any convenient manner, usually by welding.

Figure 2D:
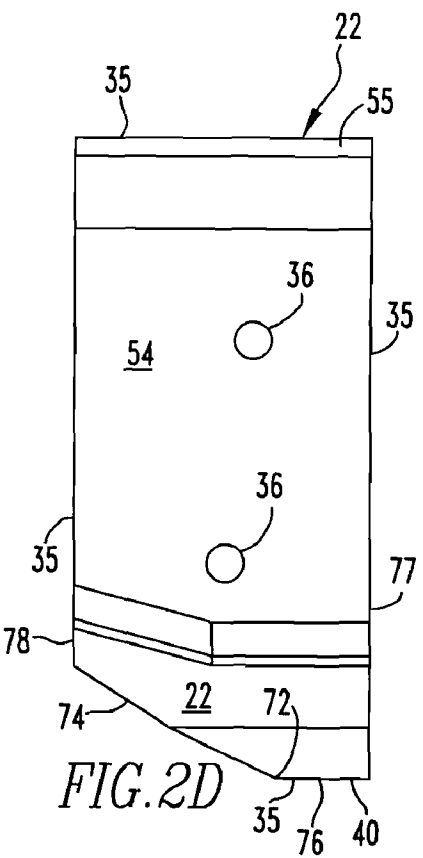
FIG. 2D is a view similar to the view of FIG. 2C, showing the pedestal.
Figure 2C:
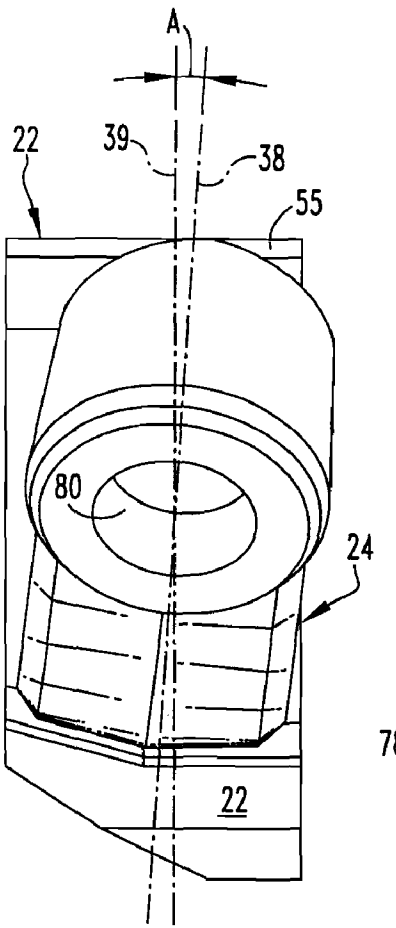
FIG. 2C is a view similar to the view of FIG. 2B showing the block mounted on the pedestal.
Figure 2B:
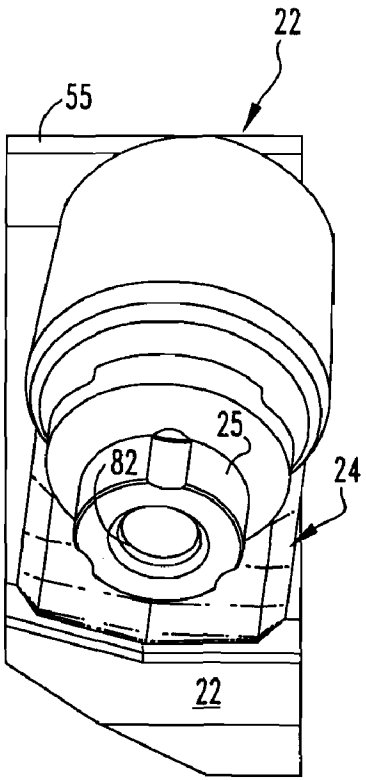
FIG. 2B is a view similar to the view of FIG. 2A showing a sleeve mounted in a block mounted on a pedestal.

In another embodiment of the invention, a step 55 (FIG. 4) defining an upwardly facing surface 54 is located at the second end 42 of the pedestal 22 (FIGS. 2D and 4).

The pedestal 22 may be shaped to promote deflection of material made loose by the cutting bit 26. With reference to FIGS. 1, 4 and 5, the first end 40 of the pedestal 22 extends above the upwardly facing surface 54 of the pedestal 22 and includes a lateral flat surface portion 74 and a frontal flat surface portion 76. As seen in FIG. 5, the lateral flat surface portions 74 of each pedestal 22 are oriented to promote deflection of material made loose by the cutting bit 26 (FIG. 1). These lateral flat surface portions 74 complement the helical angle A (FIG. 2C) of the pedestals 20 positioned about the drum 34.

Such a position of the pedestals 22 is generally illustrated in FIG. 3. For purposes of aligning the pedestals 22 with one another, a reference position 72 (FIG. 1) exists at the intersection of the lateral flat surface portion 74 and the frontal flat surface portion 76. In a preferred embodiment of the invention, the frontal flat surface portion 76 (see FIG. 2D) is at a 90 degree angle with the side 77 of the pedestal 22 and the lateral flat surface portion 74 forms an acute angle with the frontal flat surface portion 76. These two flat portions 74, 76 intersect to define the reference position 72. By aligning the reference position 72 with the side 78 of the pedestal 22 (FIG. 5), the lateral front flat surface portion 74 provides the greatest amount of deflection for material loosened by the cutting bit 26 and, furthermore, provides a visual aid for ease of alignment between pedestals 22.

Figure 2A:
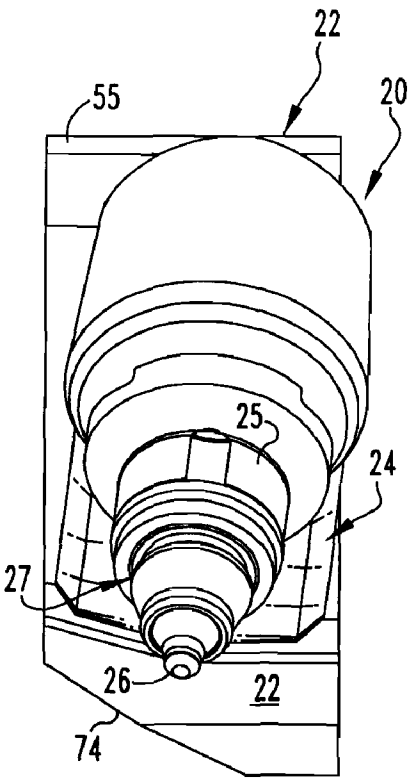
FIG. 2A is an elevated plan view of the pedestal of the invention shown in FIG. 1.

The sleeve 25 of the pedestal assembly 20 (see FIG. 2B) is secured in the passageway 80 of the block 24 (see FIG. 2C), and the sleeve 25 has a passageway 82 (see FIG. 2B) to receive the tool body 27 of the pedestal assembly 20 (see FIG. 2A). The tool body 27 of the pedestal assembly 20 is preferably detachably secured in the passageway 82 of the sleeve 25 in any convenient manner, such that the tool body 27 can be, when desired, easily replaced. More particularly, the tool body 27 can be forced out of the passageway 82 of the sleeve 25 and a new tool body 27 inserted into the passageway 82. The design and technique for detachably securing a tool body 27 into a block 24 is well known in the art and no further discussion is deemed necessary. The sleeve 25 of the pedestal assembly 20 may also provide for mounting cutting bits having different cutting shapes and properties in the blocks 24. More particularly, the end (not shown) of the sleeve 25 may be configured to accommodate various types of tool bodies.

The invention is not limited to the arrangement of the pedestal assembly on the outer surface 32 of the drum 34 (see FIGS. 3 and 4) and any arrangement of the pedestal assembly on the surface of the drum can be used in the practice of the invention. For example, the center line 39 of the pedestal 22 (see FIG. 2C) can subtend any angle, e.g. an angle between 0-180 degrees, with the rotating axis 90 (see FIG. 3) of the drum 34.

Based on the description of the embodiments of the invention, it can be appreciated that this invention is not limited to the particular embodiments disclosed, but it is intended to cover modifications that are within the spirit and scope of the invention, as defined by the appended claims.

The invention claimed is:

1. A pedestal assembly for mounting to a rotary drum comprising;

a) a pedestal having a bottom surface, an opposite top surface, a first side and an opposite second side, a first end having a recess with a downwardly facing surface, a second end having an upwardly facing surface, wherein the downwardly facing surface and the upwardly facing surface are substantially the same distance from the bottom surface, such that when mounted upon the rotary drum the downwardly facing surface of the first end of the pedestal overlaps and rests upon the upwardly facing surface of the second end of an adjacent identical pedestal, wherein the pedestal further comprises an upright member adjacent to the first end protruding from the top surface of the pedestal to provide a shoulder to protect the block and wherein the upright member further includes a lateral surface portion and a frontal surface portion adjacent to the lateral surface portion, wherein the lateral surface portion forms an obtuse angle with the frontal surface portion such that the lateral surface portion acts to provide a material conveying surface for moving material loosened by the cutting bit in a predetermined direction in response to rotation of the drum; and b) a block secured to the top surface of the pedestal, wherein the block has a passageway extending therethrough to accept a tool body for securing a cutting bit therein.

2. The pedestal assembly according to claim 1, wherein the downwardly facing surface further includes one of a projection or a cavity and the upwardly facing surface further includes the other of the projection or the cavity and, wherein the projection and cavity are mateable with one another such that when two pedestals are overlapping, the projection and cavity mate to provide lateral support to the pedestals.

3. The pedestal assembly according to claim 1, wherein the lateral surface portion is flat.

4. The pedestal assembly according to claim 3, wherein the frontal surface portion is flat.

5. The pedestal assembly according to claim 4, wherein the frontal flat surface portion adjacent to the lateral flat surface portion and, wherein the intersection of the frontal surface portion and the lateral surface portion define a reference position for alignment of adjacent pedestals.

6. The pedestal assembly according to claim 1, wherein the upright member is adjacent only to the first end of the pedestal and does not extend around the first side or the second side of the pedestal.

7. The pedestal assembly according to claim 5, wherein the upwardly facing surface of the pedestal further includes a step and the recess downwardly facing surface or an adjacent pedestal is in contact with the step.

8. A drum assembly for a rotary cutter comprising:

a) a drum with an elongated body having a first end, an opposite second end and an outer surface, the body being rotatable about an axis extending from the first end to the second end;

b) a plurality of pedestals, each adapted to receive a block, wherein each pedestal has a bottom surface securely mounted on the outer surface of the elongated body and an opposite top surface, wherein for at least one pair of adjacent pedestals, one of the pedestals has a first end with a downwardly facing surface and the adjacent pedestal has a recess with an upwardly facing surface and, wherein the downwardly facing surface of one pedestal overlaps with and contacts the upwardly facing surface of the other pedestal of the pair; and c) wherein each pedestal further comprises an upright member adjacent to the first end protruding from the top surface of the pedestal to provide a shoulder to protect the block and wherein the upright member further includes a lateral surface portion and a frontal surface portion adjacent to the lateral surface portion, wherein the lateral surface portion forms an obtuse angle with the frontal surface portion such that the lateral surface portion acts to provide a material conveying surface for moving material loosened by the cutting bit in a predetermined direction in response to rotation of the drum.

9. The drum according to claim 8, wherein the downwardly facing surface further includes one of a projection or a cavity and, wherein the upwardly facing surface further includes the other of the projection or cavity, and, wherein the projection and cavity are mateable with one another such that when the two pedestals are overlapping, the projection and cavity mate to provide lateral support to the pedestals.

10. The drum according to claim 8, wherein for the at least one pair of adjacent pedestals, the upwardly facing surface of one pedestal includes a step with a recessed surface and the downwardly facing surface of the adjacent pedestal contacts the recessed surface of the step.

11. The drum according to claim 10, wherein the frontal surface portion intersects with the lateral surface portion to define a reference position for aligning adjacent pedestals.

12. The drum according to claim 11, wherein the first side of one pedestal is spaced a predetermined distance from the reference position of the adjacent pedestal, and the first side of the one pedestal and the first side of the adjacent pedestal are offset from one another.

13. The drum according to claim 11, wherein the first side of the one pedestal is spaced a predetermined distance from the reference position of the adjacent pedestal and the first side of the one pedestal and the first side of the adjacent pedestal are aligned with one another.

14. The drum according to claim 11, wherein each of the plurality of pedestals have an upper surface, a front end, an opposite second end with the first end of each of the plurality of pedestals is similar in shape to one another and the second end of each of the plurality of pedestals similar in shape to one another, such that one pedestal of any adjacent pair of pedestals overlaps the back end of the adjacent pedestal.

15. The drum according to claim 14, wherein each of the plurality of the group of pedestals has a center line extending from the first end to the second end and the center lines are parallel to one another.

16. The drum according to claim 14, wherein each of the plurality of the group of pedestals have a plane through a center line extending from the first end to the second end and the planes of the group of pedestals are angled with respect to the axis of the body.

17. The drum according to claim 14 further comprising a bit retaining block securely mounted on the upper surface of the pedestals and a cutting bit mounted in the bit retaining block.

18. The drum according to claim 17, further including a sleeve positioned between the block and the tool body.

19. A pedestal adapted to be secured to a rotary drum used on a mining or construction machine, wherein the pedestal is adapted to support a block with a cutting bit therein and, wherein the pedestal is comprised of a body having:

a) a bottom surface and an opposite top surface;

b) a first side and an opposite second side;

d) a first end having a recess with a downwardly facing surface and a second end having a protrusion with an upwardly facing surface, wherein the downwardly facing surface and the upwardly facing surface are substantially the same distance from the bottom surface, such that when mounted upon a rotary drum the downwardly facing surface of the first end of the pedestal overlaps and rests upon the upwardly facing surface of the second end of an adjacent identical pedestal; and e) an upright member adjacent to the first end protruding from the top surface of the pedestal to provide a shoulder to protect the block and wherein the upright member further includes a lateral surface portion and a frontal surface portion adjacent to the lateral surface portion, wherein the lateral surface portion forms an obtuse angle with the frontal surface portion such that the lateral surface portion acts to provide a material conveying surface for moving material loosened by the cutting bit in a predetermined direction in response to rotation of the drum.

20. The pedestal according to claim 19, wherein the upwardly facing surface further includes one of a projection or a cavity and, wherein the downwardly facing surface further includes the other of the projection or cavity and, wherein the projection and cavity are mateable with one another such that when the two pedestals are overlapping, the projection and cavity mate to provide lateral support to the pedestals.

21. A pedestal adapted to be secured to a rotary drum used on a mining or construction machine, wherein the pedestal is adapted to support a block with a cutting bit therein and, wherein the pedestal is comprised of a body having:

a) a bottom surface and an opposite top surface;

b) a first side and an opposite second side;

d) a first end having a recess with a downwardly facing surface and a second end having a protrusion with an upwardly facing surface, wherein the downwardly facing surface and the upwardly facing surface are substantially the same distance from the bottom surface, such that when mounted upon a rotary drum the downwardly facing surface of the first end of the pedestal overlaps and rests upon the upwardly facing surface of the second end of an adjacent identical pedestal, wherein the upwardly facing surface further includes one of a projection or a cavity and, wherein the downwardly facing surface further includes the other of the projection or cavity, wherein the projection and cavity are mateable with one another such that when the two pedestals are overlapping, the projection and cavity mate to provide lateral support to the pedestals.

* * * * *